US007094466B2

(12) United States Patent
Chang

(10) Patent No.: US 7,094,466 B2
(45) Date of Patent: Aug. 22, 2006

(54) 3GT/4GT BIOCOMPONENT FIBER AND PREPARATION THEREOF

(75) Inventor: Jing C. Chang, Boothwyn, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/975,149

(22) Filed: Oct. 28, 2004

(65) Prior Publication Data

US 2006/0093814 A1 May 4, 2006

(51) Int. Cl.
*D01F 8/00* (2006.01)

(52) U.S. Cl. ..... 428/370; 428/373; 428/374

(58) Field of Classification Search ..... 428/370, 428/373, 374
See application file for complete search history.

(56) References Cited

U.S. PATENT DOCUMENTS

| | | | | |
|---|---|---|---|---|
| 3,454,460 A | | 7/1969 | Bosley | |
| 3,671,379 A | | 6/1972 | Evans et al. | |
| 4,002,427 A | * | 1/1977 | Moller et al. | 8/155.1 |
| 4,410,473 A | | 10/1983 | Iohara et al. | |
| 4,454,196 A | | 6/1984 | Iohara et al. | |
| 6,555,220 B1 | * | 4/2003 | Koyanagi et al. | 428/373 |
| 6,641,916 B1 | | 11/2003 | Chang et al. | |
| 6,692,687 B1 | | 2/2004 | Chang et al. | |
| 6,949,210 B1 | * | 9/2005 | Koyanagi et al. | 264/130 |
| 2004/0084796 A1 | | 5/2004 | Chang et al. | |

FOREIGN PATENT DOCUMENTS

| | | |
|---|---|---|
| JP | 11-189925 A | 7/1999 |
| JP | 2002-56918 A | 9/2000 |
| JP | 2002-30527 A | 1/2002 |

* cited by examiner

*Primary Examiner*—N. Edwards
(74) *Attorney, Agent, or Firm*—Mark D. Kuller; Bart E. Lerman

(57) ABSTRACT

Disclosed are side-by-side or eccentric sheath-core bicomponent fibers comprising a poly(trimethylene terephthalate) component and a poly(tetramethylene terephthalate) component and preparation and use thereof.

8 Claims, 3 Drawing Sheets

3GT/4GT BIOCOMPONENT FIBER AND PREPARATION THEREOF

FIELD OF THE INVENTION

The invention relates to bicomponent fibers comprising poly(trimethylene terephthalate) and poly(tetramethylene terephthalate) and methods of producing said bicomponent fibers.

BACKGROUND OF THE INVENTION

Poly(trimethylene terephthalate) (also referred to as "3GT" or "PTT") has recently received much attention as a polymer for use in textiles, flooring, packaging and other end uses. Textile and flooring fibers have excellent physical and chemical properties.

It is known that bicomponent fibers wherein the two components have differing degrees of orientation, as indicated by differing intrinsic viscosities, possess desirable crimp contraction properties which lead to increased value in use for said fibers.

U.S. Pat. No. 6,692,687 discloses a spinning process for the production of side-by-side or eccentric sheath-core bicomponent fibers, the two components comprising poly (ethylene terephthalate) and poly(trimethylene terephthalate), respectively. Due to the poly(ethylene terephthalate), fibers and fabrics made from them have a harsher hand than poly(trimethylene terephthalate) monocomponent fibers and fabrics. In addition, due to the poly(ethylene terephthalate) these fibers and their fabrics require high-pressure dyeing.

U.S. Pat. Nos. 4,454,196 and 4,410,473, which are incorporated herein by reference, describe a polyester multifilament yarn consisting essentially of filament groups (I) and (II). Filament group (I) is composed of polyester selected from the group poly(ethylene terephthalate), poly(trimethylene terephthalate) and poly(tetramethylene terephthalate), and/or a blend and/or copolymer comprising at least two members selected from these polyesters. Filament group (II) is composed of a substrate composed of (a) a polyester selected from the group poly(ethylene terephthalate), poly (trimethylene terephthalate) and poly(tetramethylene terephthalate), and/or a blend and/or copolymer comprising at least two members selected from these polyesters, and (b) 0.4 weight % to 8 weight % of at least one polymer selected from the group consisting of styrene type polymers, methacrylate type polymers and acrylate type polymers. The filaments can be extruded from different spinnerets, but are preferably extruded from the same spinneret. It is preferred that the filaments be blended and then interlaced so as to intermingle them, and then subjected to drawing or draw-texturing. The Examples show preparation of filaments of type (II) from poly(ethylene terephthalate) and polymethylmethacrylate (Example 1) and polystyrene (Example 3), and poly(tetramethylene terephthalate) and polyethylacrylate (Example 4). Poly(trimethylene terephthalate) was not used in the examples. These disclosures of multifilament yarns do not include a disclosure of multicomponent fibers.

U.S. Pat. Nos. 3,454,460 and 3,671,379 disclose bicomponent polyester textile fibers.

JP 11-189925, describes the manufacture of sheath-core fibers comprising poly(trimethylene terephthalate) as the sheath component and a polymer blend comprising 0.1 weight % to 10 weight %, based on the total weight of the fiber, polystyrene-based polymer as the core component. According to this application, processes to suppress molecular orientation using added low softening point polymers such as polystyrene did not work. (Reference is made to JP 56-091013 and other patent applications.) It states that the low melting point polymer present on the surface layer sometimes causes melt fusion when subjected to a treatment such as false-twisting (also known as "texturing"). Other problems mentioned included cloudiness, dye irregularities, blend irregularities and yarn breakage. According to this application, the core contains polystyrene and the sheath does not. Example 1 describes preparation of a fiber with a sheath of poly(trimethylene terephthalate) and a core of a blend of polystyrene and poly(trimethylene terephthalate), with a total of 4.5% of polystyrene by weight of the fiber.

JP 2002-56918A discloses sheath-core or side-by-side bicomponent fibers wherein one side (A) comprises at least 85 mole % poly(trimethylene terephthalate) and the other side comprises (B) at least 85 mole % poly(trimethylene terephthalate) copolymerized with 0.05–0.20 mole % of a trifunctional comonomer; or the other side comprises (C) at least 85 mole % poly(trimethylene terephthalate) not copolymerized with a trifunctional comonomer wherein the inherent viscosity of (C) is 0.15 to 0.30 less than that of (A). It is disclosed that the bicomponent fibers obtained were pressure dyed at 130° C.

Japanese unexamined patent application 2002-30527 discloses side by side type polyester-based conjugated fiber obtained by conjugating polyesters having different viscosities in a conjugating ratio of 65:35–35:65, comprising component A including poly(trimethylene terephthalate) as a main constituent and component B including poly(butylene terephthalate) as a main constituent, the intrinsic viscosities of the component A and B satisfy the formula $1.5 \leqq Ia/Ib \leqq 2.5$ (Ia is the intrinsic viscosity of component A and Ib is the intrinsic viscosity of component B), and the fiber has the following characteristics: elongation rate of crimp $\leqq 20\%$, elongation rate of stretching $\geqq 10\%$, stretch modulus of elongation $\geqq 90\%$, and Uster irregularity $\leqq 2.0\%$.

Co-owned U.S. Pat. No. 6,641,916 and co-owned, co-pending U.S. Patent Application No. 2004/0084796, which are incorporated by reference, disclose a side-by-side or eccentric sheath-core bicomponent fiber wherein each component comprises a different poly(trimethylene terephthalate) composition and wherein at least one of the compositions comprises styrene polymer dispersed throughout the poly(trimethylene terephthalate).

It is desirable to produce bicomponent fibers of poly (trimethylene terephthalate) and poly(tetramethylene terephthalate) having soft hand and high dye uptake. It is also desirable to dye such bicomponent fibers at atmospheric pressure.

SUMMARY OF THE INVENTION

One aspect of this invention is to provide a side-by-side or eccentric sheath-core bicomponent fiber comprising a poly(trimethylene terephthalate) component having an intrinsic viscosity in a range of from about 0.80 dl/g to about 1.20 dl/g, preferably about 1.0 dl/g, and a poly(tetramethylene terephthalate) component having an intrinsic viscosity in a range of from about 0.98 dl/g to about 1.24 dl/g, preferably about 1.1 dl/g. Preferred poly(trimethylene terephthalate)s contain at least 85 mole %, more preferably at least 90 mole %, even more preferably at least about 95% or at least about 98 mole %, and most preferably about 100 mole % trimethylene terephthalate repeat units. Preferred poly(tetramethylene terephthalate)s contain at least 85 mole %, more preferably at least 90 mole %, even more preferably at least about 95% or at least about 98 mole %, and most preferably about 100 mole % tetramethylene terephthalate repeat units.

Another aspect of this invention is to provide a process for preparing a side-by-side or eccentric sheath-core bicomponent fiber comprising:

(a) providing a poly(trimethylene terephthalate) component having an intrinsic viscosity in a range of from about 0.80 dl/g to about 1.20 dl/g and a poly(tetramethylene terephthalate) component having an intrinsic viscosity in a range of from about 0.98 dl/g to about 1.24 dl/g; and (b) spinning the poly(trimethylene terephthalate) component and poly(tetramethylene terephthalate) component to form side-by-side or eccentric sheath-core bicomponent fibers.

A further aspect of the invention is to provide a process for preparing fully drawn yarn comprising crimped poly (trimethylene terephthalate)/poly(tetramethylene terephthalate) bicomponent fibers comprising:

(a) providing a poly(trimethylene terephthalate) component having an intrinsic viscosity in a range of from about 0.80 dl/g to about 1.20 dl/g and a poly(tetramethylene terephthalate) component having an intrinsic viscosity in a range of from about 0.98 dl/g to about 1.24 dl/g;

(b) melt spinning the poly(trimethylene terephthalate) component and poly(tetramethylene terephthalate) component from a spinneret to form at least one bicomponent fiber having either a side-by-side or eccentric sheath-core cross-section;

(c) passing the fiber through a quench zone below the spinneret;

(d) drawing the fiber at a temperature of about 50° C. to about 170° C. at a draw ratio of about 1.4 to about 4.5;

(e) heat-treating the drawn fiber at about 110° C. to about 170° C.;

(f) optionally interlacing the filaments; and (g) winding-up the filaments.

Another aspect is a process for preparing poly(trimethylene terephthalate)/poly(tetramethylene terephthalate) self-crimped bicomponent staple fiber comprising:

(a) providing a poly(trimethylene terephthalate) component having an intrinsic viscosity in a range of from about 0.80 dl/g to about 1.20 dl/g and a poly(tetramethylene terephthalate) component having an intrinsic viscosity in a range of from about 0.98 dl/g to about 1.24 dl/g;

(b) melt-spinning the poly(trimethylene terephthalate) component and poly(tetramethylene terephthalate) component through a spinneret to form at least one bicomponent fiber having either a side-by-side or eccentric sheath-core cross-section;

(c) passing the fiber through a quench zone below the spinneret;

(d) optionally winding the fibers or placing them in a can;

(e) drawing the fiber;

(f) heat-treating the fiber; and (g) cutting the fibers into about 1.27 cm to about 15.24 cm staple fiber.

A further aspect is a process for producing a dyed side-by-side or eccentric sheath-core bicomponent fiber comprising:

(a) providing a poly(trimethylene terephthalate) component having an intrinsic viscosity in a range of from about 0.80 dl/g to about 1.20 dl/g and a poly(tetramethylene terephthalate) component having an intrinsic viscosity in a range of from about 0.98 dl/g to about 1.24 dl/g;

(b) melt-spinning spinning the poly(trimethylene terephthalate) component and poly(tetramethylene terephthalate) component to form side-by-side or eccentric sheath-core bicomponent fibers; and (c) dyeing the side-by-side or eccentric sheath-core bicomponent fibers of step (b) under atmospheric pressure.

Other objects and advantages of the present invention will become apparent to those skilled in the art upon reference to the detailed description that hereinafter follows.

DETAILED DESCRIPTION OF THE INVENTION

Figure 1:
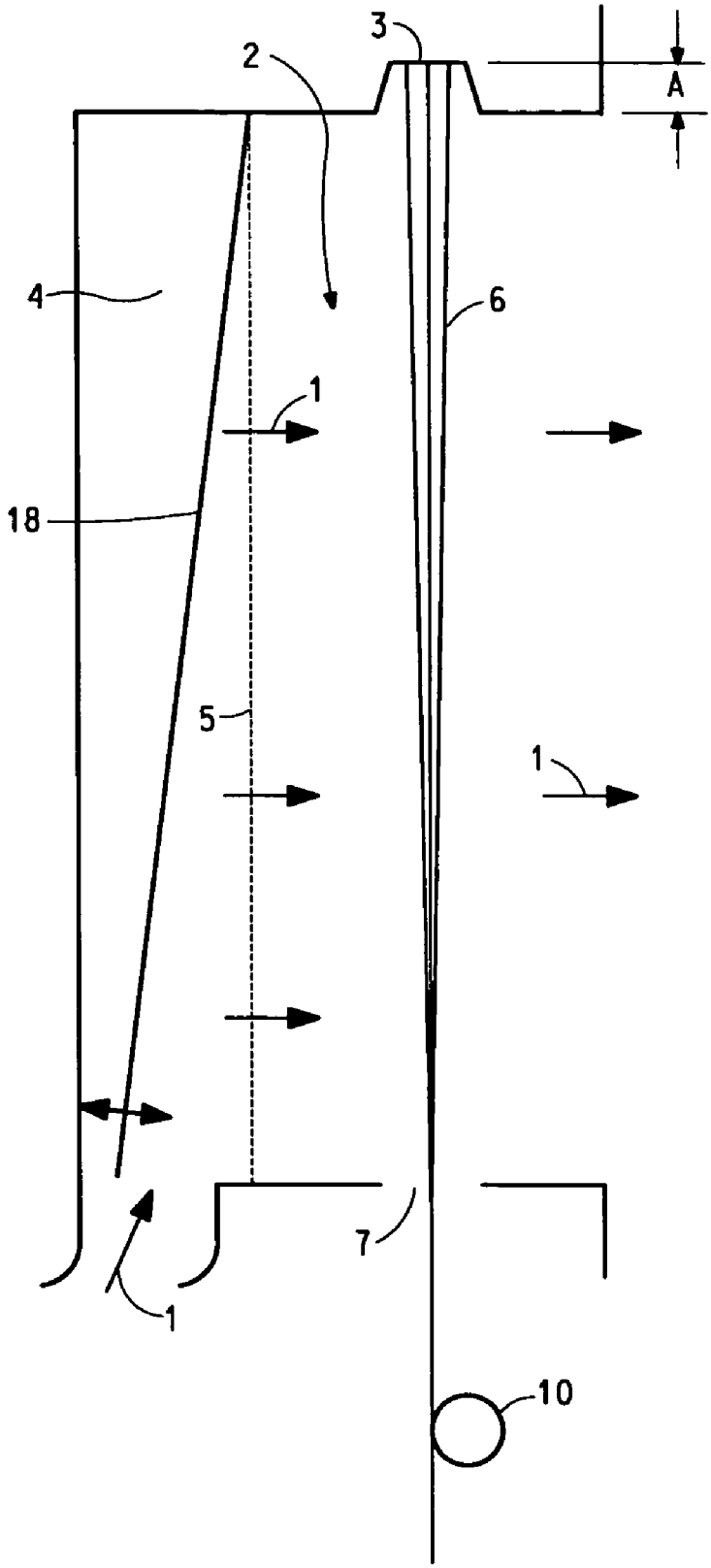
FIG. 1 illustrates a cross-flow quench melt-spinning apparatus useful in the preparation of the products of the present invention.

Applicants specifically incorporate the entire content of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

As used herein, "bicomponent fiber" means a fiber comprising a pair of polymers intimately adhered to each other along the length of the fiber, so that the fiber cross-section is for example a side-by-side, eccentric sheath-core or other suitable cross-sections from which useful crimp can be developed.

In the absence of an indication to the contrary, a reference to "poly(trimethylene terephthalate)" ("3GT" or "PTT") is meant to encompass homopolymers and copolymers containing at least 70 mole % trimethylene terephthalate repeat units and polymer compositions comprising at least 70 mole % of the homopolymers and copolymers. The preferred poly(trimethylene terephthalate)s contain at least 85 mole %, more preferably at least 90 mole %, even more preferably at least about 95% or at least about 98 mole %, and most preferably about 100 mole % trimethylene terephthalate repeat units.

In the absence of an indication to the contrary, a reference to "poly(tetramethylene terephthalate)" ("4GT" or "PTMT") is meant to encompass homopolymers and copolymers containing at least 70 mole % tetramethylene terephthalate repeat units and polymer compositions comprising at least 70 mole % of the homopolymers and copolymers. The preferred poly(tetramethylene terephthalate)s contain at least 85 mole %, more preferably at least 90 mole %, even more preferably at least about 95% or at least about 98 mole %, and most preferably about 100 mole % tetramethylene terephthalate repeat units.

Examples of copolymers include copolyesters made using 3 or more reactants, each having two ester forming groups. For example, a copoly(trimethylene terephthalate) can be used in which the comonomer used to make the copolyester is selected from the group consisting of linear, cyclic, and branched aliphatic dicarboxylic acids having 4–12 carbon atoms (for example butanedioic acid, pentanedioic acid, hexanedioic acid, dodecanedioic acid, and 1,4-cyclo-hexanedicarboxylic acid); aromatic dicarboxylic acids other than terephthalic acid and having 8–12 carbon atoms (for example isophthalic acid and 2,6-naphthalenedicarboxylic acid); linear, cyclic, and branched aliphatic diols having 2–8 carbon atoms (other than 1,3-propanediol, for example, ethanediol, 1,2-propanediol, 1,4-butanediol, 3-methyl-1,5-pentanediol, 2,2-dimethyl-1,3propanediol, 2-methyl-1,3-propanediol, and 1,4-cyclohexanediol); and aliphatic and aromatic ether glycols having 4–10 carbon atoms (for example, hydroquinone bis(2-hydroxyethyl) ether, or a poly (ethylene ether) glycol having a molecular weight below about 460, including diethyleneether glycol). The comonomer typically is present in the copolyester at a level in the range of about 0.5 mole % to about 15 mole %, and can be present in amounts up to 30 mole %.

The poly(trimethylene terephthalate) can contain minor amounts of other comonomers, and such comonomers are usually selected so that they do not have a significant adverse effect on properties. Such other comonomers include 5-sodium-sulfoisophthalate, for example, at a level in the range of about 0.2 mole % to 5 mole %. Very small amounts of trifunctional comonomers, for example trimellitic acid, can be incorporated for viscosity control.

The poly(trimethylene terephthalate) and/or poly(tetramethylene terephthalate) can be blended with up to 30 mole % of other polymers. Examples are polyesters prepared from other diols, such as those described above.

The intrinsic viscosity (IV) of the poly(trimethylene terephthalate) used in the invention is in a range of from about 0.80 dl/g to about 1.20 dl/g. Preferably, the IV of the poly(trimethylene terephthalate) is about 1.0 dl/g. The IV of the poly(tetramethylene terephthalate) used in the invention is in a range of from about 0.98 dl/g to about 1.24 dl/g. Preferably, the IV of the poly(tetramethylene terephthalate) used in the invention is about 1.1 dl/g.

Bicomponent fibers produced by a process of the invention typically have an IV in a range of from about 0.79 dl/g to about 1.09 dl/g.

Poly(trimethylene terephthalate) and preferred manufacturing techniques for making poly(trimethylene terephthalate) are described in U.S. Pat. Nos. 5,015,789, 5,276,201, 5,284,979, 5,334,778, 5,364,984, 5,364,987, 5,391,263, 5,434,239, 5,510,454, 5,504,122, 5,532,333, 5,532,404, 5,540,868, 5,633,018, 5,633,362, 5,677,415, 5,686,276, 5,710,315, 5,714,262, 5,730,913, 5,763,104, 5,774,074, 5,786,443, 5,811,496, 5,821,092, 5,830,982, 5,840,957, 5,856,423, 5,962,745, 5,990,265, 6,235,948, 6,245,844, 6,255,442, 6,277,289, 6,281,325, 6,312,805, 6,325,945, 6,331,264, 6,335,421, 6,350,895, 6,353,062, and 6,538,076, EP 998 440, WO 00/14041 and 98/57913, H. L. Traub, "Synthese und textilchemische Eigenschaften des Poly-Trimethyleneterephthalats", Dissertation Universitat Stuttgart (1994), and S. Schauhoff, "New Developments in the Production of Poly(trimethylene terephthalate) (PTT)", Man-Made Fiber Year Book (September 1996), all of which are incorporated herein by reference. Poly(trimethylene terephthalate)s useful in the invention are commercially available from E. I. du Pont de Nemours and Company, Wilmington, Del., under the trademark Sorona®.

The poly(trimethylene terephthalate) can also be an acid-dyeable polyester composition as described in U.S. Pat. No. 6,576,340 or 6,723,799, both of which are incorporated herein by reference. The poly(trimethylene terephthalate)s of U.S. Pat. No. 6,576,340 comprise a secondary amine or secondary amine salt in an amount effective to promote acid-dyeability of the acid dyeable and acid dyed polyester compositions. Preferably, the secondary amine unit is present in the composition in an amount of at least about 0.5 mole %, more preferably at least 1 mole %. The secondary amine unit is present in the polymer composition in an amount preferably of about 15 mole % or less, more preferably about 10 mole % or less, and most preferably 5 mole % or less, based on the weight of the composition. The acid-dyeable poly(trimethylene terephthalate) compositions of U.S. Pat. No. 6,723,799 comprise poly(trimethylene terephthalate) and a polymeric additive based on a tertiary amine. The polymeric additive is prepared from (i) triamine containing secondary amine or secondary amine salt unit(s) and (ii) one or more other monomer and/or polymer units. One preferred polymeric additive comprises polyamide selected from the group consisting of poly-alkylimino-bis-alkylene-adipamides, -terephthalamides, -isophthalamides, -1,6-naphthalamides, and salts thereof. The poly(trimethylene terephthalate) useful in this invention can also be cationically dyeable or dyed composition such as those described in U.S. Pat. No. 6,312,805, which is incorporated herein by reference, and dyed or dye-containing compositions.

Poly(tetramethylene terephthalate)s useful in the invention are commercially available from E. I. du Pont de Nemours and Company, Wilmington, Del., under the trademark Crastin®.

Other polymeric additives can be added to the poly (trimethylene terephthalate) and/or poly(tetramethylene terephthalate) to improve strength, to facilitate post extrusion processing, or to provide other benefits. For example, hexamethylene diamine can be added in minor amounts of about 0.5 mole % to about 5 mole % to add strength and processability to the acid dyeable polyester compositions of the invention. Polyamides such as nylon 6 or nylon 6-6 can be added in minor amounts of about 0.5 mole % to about 5 mole % to add strength and processability to the acid-dyeable polyester compositions of the invention. A nucleating agent, preferably 0.005 mole % to 2 weight % of a mono-sodium salt of a dicarboxylic acid selected from the group consisting of monosodium terephthalate, mono sodium naphthalene dicarboxylate and mono sodium isophthalate, as a nucleating agent, can be added as described in U.S. Pat. No. 6,245,844, which is incorporated herein by reference.

The poly(trimethylene terephthalate) and/or poly(tetramethylene terephthalate) can, if desired, contain additives, e.g., delusterants, nucleating agents, heat stabilizers, viscosity boosters, optical brighteners, pigments, and antioxidants. $TiO_2$ or other pigments can be added to the poly(trimethylene terephthalate) and/or poly(tetramethylene terephthalate), the composition, or in fiber manufacture. (See, e.g., U.S. Pat. Nos. 3,671,379, 5,798,433 and 5,340,909, EP 699 700 and 847 960, and WO 00/26301, which are incorporated herein by reference.)

The poly(trimethylene terephthalate) component and poly (tetramethylene terephthalate) component can be prepared using a number of techniques. Preferably the poly(trimethylene terephthalate) component and the poly(tetramethylene terephthalate) component are melt blended and, then, extruded and cut into pellets. ("Pellets" is used generically in this regard, and is used regardless of shape so that it is used to include products sometimes called "chips", "flakes", etc.) The pellets are then remelted and extruded into filaments. The term "mixture" is used when specifically referring to the pellets prior remelting, and the term "blend" is used when referring to the molten composition (e.g., after remelting).

FIG. 1 illustrates a crossflow melt-spinning apparatus which is useful in the process of the invention. Quench gas 1 enters zone 2 below spinneret face 3 through plenum 4, past hinged baffle 18 and through screens 5, resulting in a substantially laminar gas flow across still-molten fibers 6 which have just been spun from capillaries (not shown) in the spinneret. Baffle 18 is hinged at the top, and its position can be adjusted to change the flow of quench gas across zone 2. Spinneret face 3 is recessed above the top of zone 2 by distance A, so that the quench gas does not contact the just-spun fibers until after a delay during which the fibers may be heated by the sides of the recess. Alternatively, if the spinneret face is not recessed, an unheated quench delay space can be created by positioning a short cylinder (not shown) immediately below and coaxial with the spinneret face. The quench gas, which can be heated if desired, continues on past the fibers and into the space surrounding the apparatus. Only a small amount of gas can be entrained by the moving fibers which leave zone 2 through fiber exit 7. Finish can be applied to the now-solid fibers by optional finish roll 10, and the fibers can then be passed to the rolls illustrated in FIG. 2.

Figure 2:
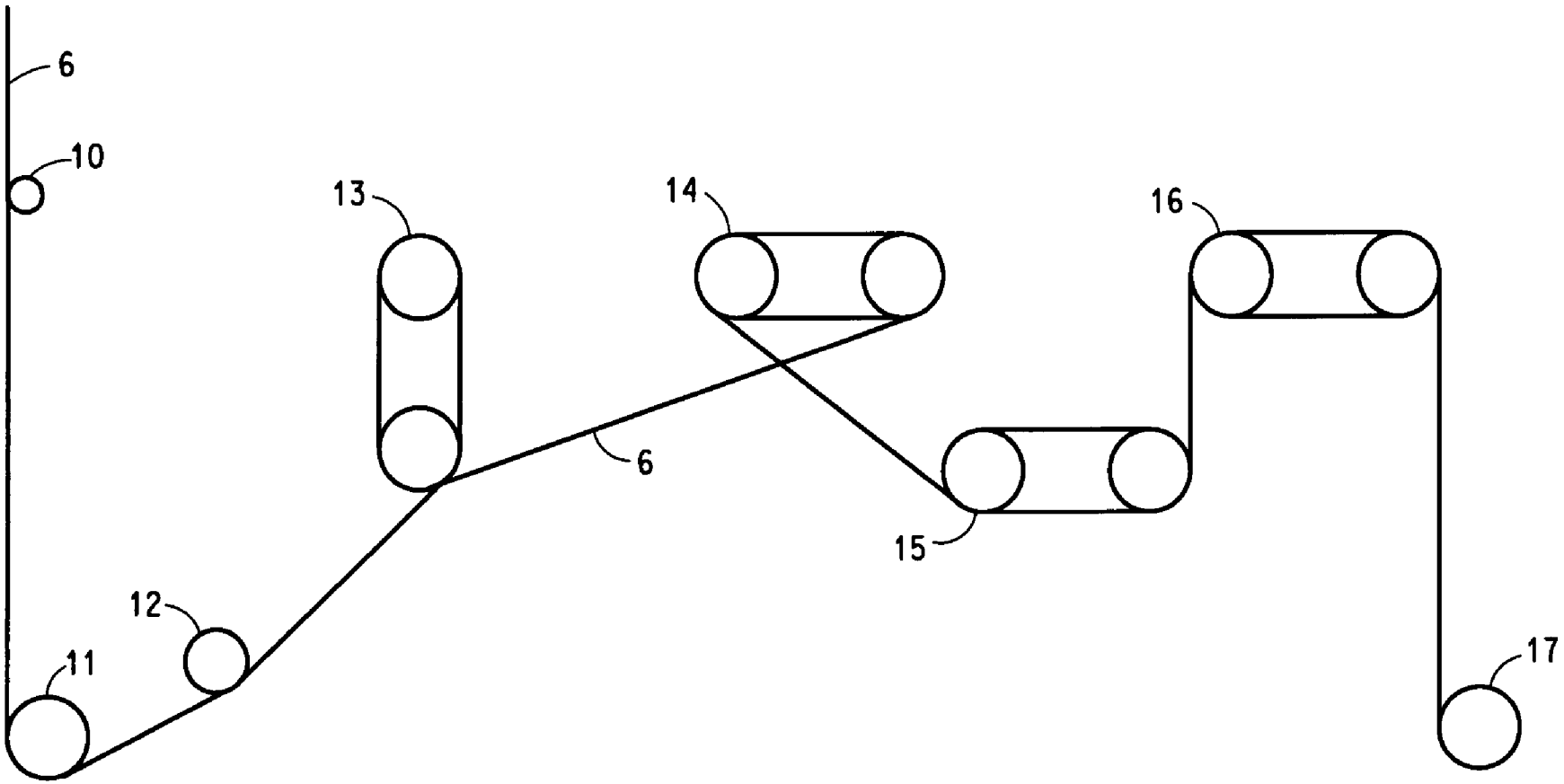
FIG. 2 illustrates an example of a roll arrangement that can be used in conjunction with the melt-spinning apparatus of FIG. 1.

In FIG. 2, fiber 6, which has just been spun for example from the apparatus shown in FIG. 1, can be passed by (optional) finish roll 10, around driven roll 11, around idler roll 12, and then around heated feed rolls 13. The temperature of feed rolls 13 can be in the range of about 50° C. to about 70° C. The fiber can then be drawn by heated draw rolls 14. The temperature of draw rolls 14 can be in the range of about 50° C. to about 170° C., preferably about 100° C. to about 120° C. The draw ratio (the ratio of wind-up speed to withdrawal or feed roll speed) is in the range of about 1.4 to about 4.5, preferably about 3.0 to about 4.0. No significant tension (beyond that necessary to keep the fiber on the rolls) need be applied between the pair of rolls 13 or between the pair of rolls 14.

After being drawn by rolls 14, the fiber can be heat-treated by rolls 15, passed around optional unheated rolls 16 (which adjust the yarn tension for satisfactory winding), and then to windup 17. Heat treating can also be carried out with one or more other heated rolls, steam jets or a heating chamber such as a "hot chest". The heat-treatment can be carried out at substantially constant length, for example, by rolls 15 in FIG. 2, which heat the fiber to a temperature in the range of about 110° C. to about 170° C., preferably about 120° C. to about 160° C. The duration of the heat-treatment is dependent on yarn denier; what is important is that the fiber can reach substantially the same temperature as that of the rolls. If the heat-treating temperature is too low, crimp can be reduced under tension at elevated temperatures, and shrinkage can be increased. If the heat-treating temperature is too high, operability of the process becomes difficult because of frequent fiber breaks. It is preferred that the speeds of the heat-treating rolls and draw rolls be substantially equal in order to keep fiber tension substantially constant at this point in the process and thereby avoid loss of fiber crimp.

Alternatively, the feed rolls can be unheated, and drawing can be accomplished by a draw-jet and heated draw rolls which also heat-treat the fiber. An interlace jet optionally can be positioned between the draw/heat-treat rolls and windup.

Finally, the fiber is wound up. A typical wind up speed in the manufacture of the products of the present invention is 3,200 meters per minute (mpm). The range of usable wind up speeds is about 2,000 mpm to 6,000 mpm.

Figure 3:
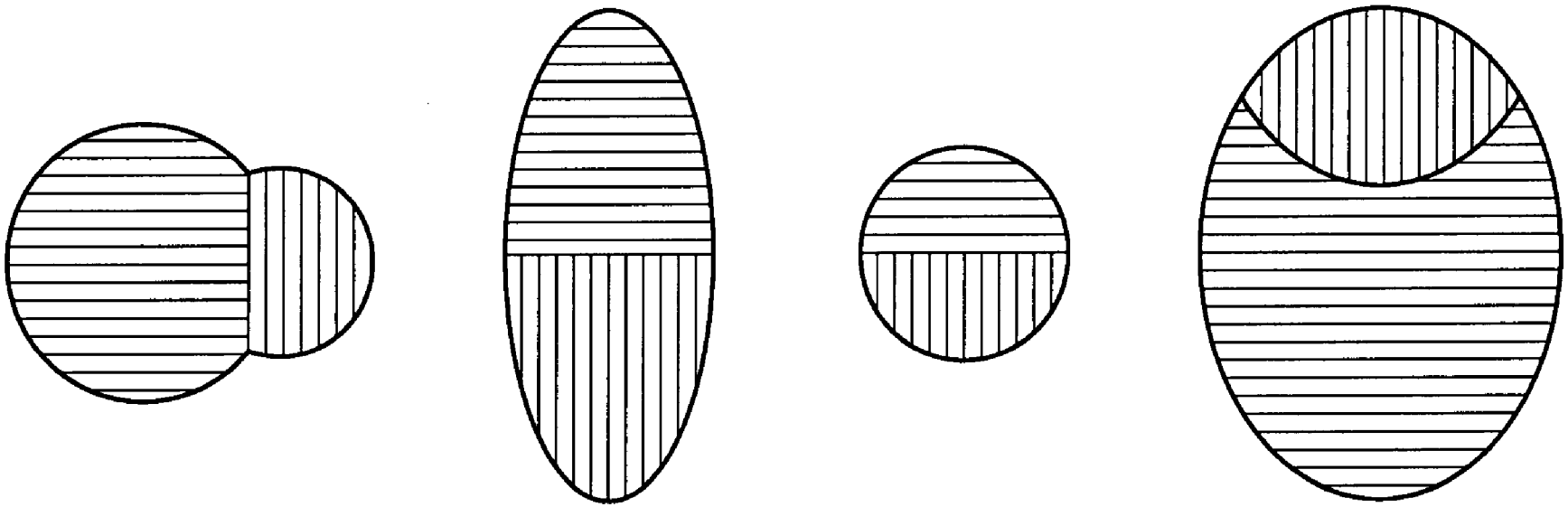
FIG. 3 illustrates examples of cross-sectional shapes that can be made by the process of the invention.

As illustrated in FIG. 3, side-by-side fibers made by the process of the invention can have a "snowman" ("A"), oval ("B"), or substantially round ("C1", "C2") cross-sectional shape. Other shapes can also be prepared. Eccentric sheath-core fibers can have an oval or substantially round cross-sectional shape. By "substantially round" it is meant that the ratio of the lengths of two axes crossing each other at 90° in the center of the fiber cross-section is no greater than about 1.2:1. By "oval" it is meant that the ratio of the lengths of two axes crossing each other at 90° in the center of the fiber cross-section is greater than about 1.2:1. A "snowman" cross-sectional shape can be described as a side-by-side cross-section having a long axis, a short axis and at least two maxima in the length of the short axis when plotted against the long axis.

Preferably, prior to spinning, the composition is heated to a temperature above the melting point of each the poly (trimethylene terephthalate) and poly(tetramethylene terephthalate), and the composition is extruded through a spinneret at a temperature of about 235° C. to about 295° C., preferably at least about 250° C. and up to about 290° C., most preferably up to about 270° C. Higher temperatures are useful with short residence time.

The invention is also directed to a process for preparing poly(trimethylene terephthalate)/poly(tetramethylene terephthalate) side-by-side or eccentric sheath-core bicomponent fibers comprising (a) providing a poly(trimethylene terephthalate) component having an intrinsic viscosity of about 1.0 dl/g and a poly(tetramethylene terephthalate) component having an intrinsic viscosity of about 1.1 dl/g, and (b) spinning the poly(trimethylene terephthalate) and poly(tetramethylene terephthalate) to form side-by-side or eccentric sheath-core bicomponent fibers. Preferably the side-by-side or eccentric sheath-core bicomponent fibers are in the form of a partially oriented multifilament yarn.

In another preferred embodiment, the invention is directed to a process for preparing poly(trimethylene terephthalate)/poly(tetramethylene terephthalate) bicomponent self-crimping yarn comprising poly(trimethylene terephthalate)/poly(tetramethylene terephthalate) bicomponent filaments, comprising (a) preparing partially oriented poly (trimethylene terephthalate)/poly(tetramethylene terephthalate) multifilament yarn, (b) winding the partially oriented yarn on a package, (c) unwinding the yarn from the package, (d) drawing the bicomponent filament yarn to form a drawn yarn, (e) annealing the drawn yarn, and (f) winding the yarn onto a package.

In yet another preferred embodiment, the invention is directed to a process for preparing fully drawn yarn comprising crimped poly(trimethylene terephthalate)/poly(tetramethylene terephthalate) bicomponent fibers, comprising the steps of: (a) providing the poly(trimethylene terephthalate) and poly(tetramethylene terephthalate); (b) melt-spinning the poly(trimethylene terephthalate) and poly(tetramethylene terephthalate) from a spinneret to form at least one bicomponent fiber having either a side-by-side or eccentric sheath-core cross-section; (c) passing the fiber through a quench zone below the spinneret; (d) drawing the fiber (preferably at temperature of about 50° C. to about 170° C. and preferably at a draw ratio of about 1.4 to about 4.5); (e) heat-treating (e.g., annealing) the drawn fiber (preferably at about 110° C. to about 170° C.); (f) optionally interlacing the filaments; and (g) winding-up the filaments.

In another preferred embodiment, the process further comprises cutting the fibers into staple fibers. In one preferred embodiment, the invention is directed to a process for preparing poly(trimethylene terephthalate)/poly(tetramethylene terephthalate) self-crimped bicomponent staple fiber comprising: (a) providing the poly(trimethylene terephthalate) and poly(tetramethylene terephthalate); (b) melt-spinning the poly(trimethylene terephthalate) and poly(tetramethylene terephthalate) through a spinneret to form at least one bicomponent fiber having either a side-by-side or eccentric sheath-core cross-section; (c) passing the fiber through a quench zone below the spinneret; (d) optionally winding the fibers or placing them in a can; (e) drawing the fiber (preferably at a temperature of about 50° C. to about 170° C. and preferably at a draw ratio of about 1.4 to about 4.5); (f) heat-treating the drawn fiber (preferably at about 110° C. to about 170° C.); and (g) cutting the fibers into about 0.5 inches (about 1.27 cm) to about 6 inches (about 15.24 cm) staple fiber.

Advantages of the invention over fibers and fabrics made from poly(trimethylene terephthalate) and poly(ethylene terephthalate) include softer hand, higher dye-uptake, and the ability to dye under atmospheric pressure.

All of the compositions and methods disclosed and claimed herein can be made and executed without undue experimentation in light of the present disclosure. While the compositions and methods of this invention have been described in terms of preferred embodiments, it will be apparent to those of skill in the art that variations may be applied to the compositions and methods and in the steps or in the sequence of steps of the method described herein without departing from the concept, spirit, and scope of the invention. More specifically, it will be apparent that certain agents which are chemically related may be substituted for the agents described herein while the same or similar results would be achieved. All such similar substitutes and modifications apparent to those skilled in the art are deemed to be within the spirit, scope, and concept of the invention as defined by the appended claims.

EXAMPLE

The present invention is further defined in the following Example. It should be understood that this Example, while indicating preferred embodiments of the invention, are given by way of illustration only. From the above discussion and this Example, one skilled in the art can ascertain the preferred features of this invention, and without departing from the spirit and scope thereof, can make various changes and modifications of the invention to adapt it to various uses and conditions.

The meaning of abbreviations is as follows: "h" means hour(s), "min" means minute(s), "mm" means millimeter(s), "cm" means centimeter(s), "g" means gram(s), "mg" means milligram(s), "kg" means kilograms, "dtex" means decitex, "wt %" means weight percent(age), "mpm" means meters per minute, "gpd" means grams per denier, "dN" means deciNewton(s), "den" means count denier, "dl" means deciliter(s), "2GT" means poly(ethylene terephthalate), "3GT" means poly(trimethylene terephthalate), "4GT" means poly (tetramethylene terephthalate), and "IV" means intrinsic viscosity.

In the Example, the draw ratio applied was about the maximum operable draw ratios in obtaining bi-component fibers. Unless otherwise indicated, rolls 13 in FIG. 2 were operated at about 70° C., rolls 14 at about 90° C. and 3200 mpm, and rolls 15 at about 120° C.–160° C.

IV of the polyesters was measured with a Viscotek Forced Flow Viscometer Model Y-900 at a 0.4% concentration at 19° C. and according to ASTM D-4603-96 but in 50/50 wt % trifluoroacetic acid/methylene chloride instead of the prescribed 60/40 wt % phenol/1,1,2,2-tetrachloroethane. The measured viscosity was then correlated with standard viscosities in 60/40 wt % phenol/1,1,2,2-tetrachloroethane to arrive at the reported intrinsic values. IV in the fiber was measured by exposing polymer to the same process conditions as polymer actually spun into bicomponent fiber except that the test polymer was spun without a pack/spinneret (which did not combine the two polymers into a single fiber) and then collected for IV measurement. Or, IV in the fiber was measured as actually spun bicomponent fiber.

Unless otherwise noted, the crimp contraction in the bicomponent fiber made as shown in the Example was measured as follows. Each sample was formed into a skein of 5000±5 total denier (5550 dtex) with a skein reel at a tension of about 0.1 gpd (0.09 dN/tex). The skein was conditioned at 70±2° F. (21±1° C.) and 65±2% relative humidity for a minimum of 16 h. The skein was hung substantially vertically from a stand, a 1.5 mg/den (1.35 mg/dtex) weight (e.g., 7.5 g for 5550 dtex skein) was hung on the bottom of the skein, the weighted skein was allowed to come to an equilibrium length, and the length of the skein was measured to within 1 mm and recorded as "Cb". The 1.35 mg/dtex weight was left on the skein for the duration of the test. Next, a 500 mg weight (100 mg/d; 90 mg/dtex) was hung from the bottom of the skein, and the length of the skein was measured within 1 mm and recorded as "Lb". Crimp contraction value (percent) (before heatsetting, as described below for this test), "CCb", was calculated according to the formula:

$$CCb=100\times(Lb-Cb)/Lb$$

The 500-g weight was removed and the skein was then hung on a rack and heatset, with the 1.35 mg/dtex weight stall in place, in an oven for 5 min at about 212° F. (100° C.), after which the rack and skein were removed from the oven and conditioned as above for 2 h. This step is designed to simulate commercial dry heat-setting, which is one way to develop the final crimp in the bicomponent fiber. The length of the skein was measured as above, and its length was recorded as "Ca". The 500-g weight was again hung from the skein, and the skein length was measured as above and recorded as "La". The after heat-set crimp contraction value (%), "CCa", was calculated according to the formula:

$$CCa=100\times(La-Ca)/La$$

CCa is reported in the tables. After-heatset, crimp contraction values obtained from this test are within this invention if they are 1.00–50.0.

In spinning the bicomponent fibers in the Examples, the polymers were melted with Werner & Pfleiderer co-rotating 28-mm extruders having 0.5–40 pound/hour (0.23–18.1 kg/h) capacities. The highest melt temperatures attained in the 2GT extruder was about 280–285° C., and the corresponding temperature in the 3GT extruder was about 265–275° C., and the corresponding temperature in the 4GT extruder was about 265–275° C. Pumps transferred the polymers to the spinning head. In the Example, the fibers were wound up with a Barmag SW6 2s 600 winder (Barmag AG, Germany), having a maximum winding speed of 6000 mpm.

The spinneret used in the Example was a post-coalescence bicomponent spinneret having thirty-four pairs of capillaries arranged in a circle, an internal angle between each pair of capillaries of 30°, a capillary diameter of 0.64 mm, and a capillary length of 4.24 mm. Unless otherwise noted, the weight ratio of the two polymers in the fiber was 50/50.

Yarns were single knit to form knit sleeves using a Lawson-Hemphill Model FAK knitting machine. All knit sleeves from Table I were dyed together. Intrasil Blue GLF 100% (2% on weight of fabric) was used for disperse dyeing. Knit sleeves from bicomponent yarn was disperse dyed with Blue GLF in a Gaston County mini-lab jet dyer. This procedure is to reveal defects and to show dyeability of yarns. It is also helpful in determining the percent of or level of dye up-take of one yarn versus other yarns.

After knit sleeves were scoured, dye bath was raised to 140° F. (60° C.) and dye was added to the bath. After the dye goes under pressure (at about 190° F. (87.8° C.)), knit sleeves were run for 15 min reaching a maximum temperature of 240° F. (115.6° C.). Bath temperature was decreased to bring dyer out of pressure and sleeves were rinsed and dried. The sleeve is now ready for Color Eye color analysis. Macbeth Color Eye Model 112020 PL (Newburgh, N.Y.), which uses software from SheLyn, Inc. (Greensboro, N.C.) to calculate the color, was used. Color Value from the measurement is based on the same single wavelength. Relative % Dye is calculated based on Color Value to reflect the relative shade depth difference.

Poly(ethylene terephthalate) (2GT, Crystar® 4423, a registered trademark of E. I. du Pont de Nemours and Company), having an intrinsic viscosity of 0.49 dl/g; poly (trimethylene terephthalate) (3GT, Sorona®, a registered trademark of E. I. du Pont de Nemours and Company), having an intrinsic viscosity of 1.00 dl/g (and a further 3GT component having an intrinsic viscosity of 0.85 dl/g for the 3GT/3GT fiber); and poly(tetramethylene terephthalate) (4GT, Crastin® 6130, a registered trademark of E. I. du Pont de Nemours and Company) having an intrinsic viscosity of 1.11 dl/g were spun using the apparatus of FIG. 1. The spinneret temperature was maintained at less than 265° C. The (post-coalescence) spinneret was recessed into the top of the spinning column by 4 inches (10.2 cm) ("A" in FIG. 1) so that the quench gas contacted the just-spun fibers only after a delay. The quench gas was air, supplied at room temperature of about 20° C. The fibers had a side-by-side cross-section similar to A of FIG. 3.

TABLE I

| 3GT/3GT & 3GT/4GT vs. 3GT/2GT | | | | | | | | | | | | |
|---|---|---|---|---|---|---|---|---|---|---|---|---|
| Chip IV West (dl/g) | Chip IV East (dl/g) | Polymer West | Polymer East | Fiber IV (dl/g) | Draw Ratio | Rolls 15 (° C.) | Denier | Tenacity (g/d) | Elongation (%) | Color Value | % Dye | Hand |
| 1.00 | 0.49 | 3GT | 2GT | 0.72 | 3.7 | 160 | 110 | 4.0 | 22 | 6.4 | 75 | Control |
| 1.00 | 0.85 | 3GT | 3GT | 0.83 | 2.5 | 120 | 100 | 2.9 | 21 | 10.4 | 113 | Softer |
| 1.00 | 1.11 | 3GT | 4GT | 0.94 | 2.4 | 120 | 94 | 4.4 | 21 | 9.2 | 113 | Softer |

The data in Table I show that 3GT/3GT and 3GT/4GT dyed sleeves exhibit higher color value (higher % dye, with surprisingly darker shade) and surprisingly softer hand than 2GT/3GT sleeve.

I claim:

1. A side-by-side or eccentric sheath-core bicomponent fiber comprising a poly(trimethylene terephthalate) component having an intrinsic viscosity in a range of from about 0.80 dl/g to about 1.20 dl/g and a poly(tetramethylene terephthalate) component having an intrinsic viscosity in a range of from about 0.98 dl/g to about 1.24 dl/g, said fiber having an intrinsic viscosity in a range of from about 0.79 dl/g to about 1.09 dl/g, a tenacity of about 4.4 g/d, and an elongation of about 21%.

2. The side-by-side or eccentric sheath-core bicomponent fiber of claim 1, wherein the poly(trimethylene terephthalate) component has an intrinsic viscosity of about 1.0 dl/g.

3. The side-by-side or eccentric sheath-core bicomponent fiber of claim 1, wherein the poly(tetramethylene terephthalate) component has an intrinsic viscosity of about 1.1 dl/g.

4. The side-by-side or eccentric sheath-core bicomponent fiber of claim 1, wherein the poly(trimethylene terephthalate) component comprises at least about 85 mole % trimethylene terephthalate repeat units and the poly(tetramethylene terephthalate) component comprises at least about 85 mole % tetramethylene terephthalate repeat units.

5. The side-by-side or eccentric sheath-core bicomponent fiber of claim 4, wherein the poly(trimethylene terephthalate) component comprises at least about 90 mole % trimethylene terephthalate repeat units and the poly(tetramethylene terephthalate) component comprises at least about 90 mole % tetramethylene terephthalate repeat units.

6. The side-by-side or eccentric sheath-core bicomponent fiber of claim 5, wherein the poly(trimethylene terephthalate) component comprises at least about 95 mole % trimethylene terephthalate repeat units and the poly(tetramethylene terephthalate) component comprises at least about 95 mole % tetramethylene terephthalate repeat units.

7. The side-by-side or eccentric sheath-core bicomponent fiber of claim 6, wherein the poly(trimethylene terephthalate) component comprises at least about 98 mole % trimethylene terephthalate repeat units and the poly(tetramethylene terephthalate) component comprises at least about 98 mole % tetramethylene terephthalate repeat units.

8. The side-by-side or eccentric sheath-core bicomponent fiber of claim 7, wherein the poly(trimethylene terephthalate) component comprises about 100 mole % trimethylene terephthalate repeat units and the poly(tetramethylene terephthalate) component comprises about 100 mole % tetramethylene terephthalate repeat units.

* * * * *